US010910171B2

(12) United States Patent
Ogawa

(10) Patent No.: US 10,910,171 B2
(45) Date of Patent: Feb. 2, 2021

(54) SWITCH DEVICE AND RUBBER CONTACT

(71) Applicant: KABUSHIKI KAISHA TOKAI RIKA DENKI SEISAKUSHO, Aichi (JP)

(72) Inventor: Sho Ogawa, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 0 days.

(21) Appl. No.: 16/387,666

(22) Filed: Apr. 18, 2019

(65) Prior Publication Data

US 2019/0326077 A1 Oct. 24, 2019

(30) Foreign Application Priority Data

Apr. 20, 2018 (JP) ..... 2018-081543

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2205/022* (2013.01); *H01H 2227/022* (2013.01)

(58) Field of Classification Search
CPC .. H01H 13/14; H01H 13/52; H01H 2227/022; H01H 2205/022; H01H 13/82;
(Continued)

(56) References Cited

U.S. PATENT DOCUMENTS 6,946,611 B2 * 9/2005 Yoneyama ..... H01H 13/82 200/515
8,552,322 B2 * 10/2013 Takai ..... H01H 13/82 200/306

(Continued)

FOREIGN PATENT DOCUMENTS

JP 60-60842 U 4/1985
JP 08115633 * 5/1996 ..... H01H 13/70

(Continued)

OTHER PUBLICATIONS

Office Action issued in related Japanese Patent Application No. 2018-081543 dated Sep. 24, 2019.

*Primary Examiner* — Edwin A. Leon
*Assistant Examiner* — Lheiren Mae A Caroc
(74) *Attorney, Agent, or Firm* — Roberts Calderon Safran & Cole P.C.

(57) ABSTRACT

A switch device includes a substrate having at least one fixed contact and an inflow/outflow section provided with at least one through-hole, and a rubber contact to cover the substrate. The rubber contact includes at least one moving section disposed facing the respective at least one fixed contact, the moving section elastically deforming such that moving contacts corresponding to the respective fixed contacts are capable of contacting/separating, an in/out section disposed facing the inflow/outflow section and configured to form a space with the inflow/outflow section, a flow path section configured to form a flow path to connect the in/out section and the at least one moving section, and at least one chamber section having a space larger than a space occupying along representative length of the flow path section on a portion of the flow path section, and having strength such that a shape of the space is maintained.

11 Claims, 3 Drawing Sheets

(58) Field of Classification Search
CPC ..... H01H 2213/00; H01H 2213/014; H01H 13/36; H01H 13/10; H01H 13/06
USPC ..... 200/306
See application file for complete search history.

(56) References Cited

U.S. PATENT DOCUMENTS

2019/0311865 A1* 10/2019 Ogawa ..... H01H 13/06
2019/0311866 A1* 10/2019 Ogawa ..... H01H 13/82

FOREIGN PATENT DOCUMENTS

JP 2001-118458 A 4/2001
JP 2010-040490 A 2/2010

* cited by examiner

SWITCH DEVICE AND RUBBER CONTACT

CROSS-REFERENCE TO RELATED APPLICATIONS

The present application is based on Japanese patent application No. 2018-081543 filed on Apr. 20, 2018, the entire contents of which are incorporated herein by reference.

BACKGROUND

Technical Field

The present invention relates to a switch device and a rubber contact.

A switch device in the related art described in JP 2010-40490 A is a rubber sheet covering one surface side of a substrate, and includes a first rubber dome, an air entrapment chamber, a second rubber dome, a first ventiduct, and a second ventiduct.

The first rubber dome is a dome-shaped portion covering a fixed contact, and including a moving contact in an inside. The air entrapment chamber covers an end portion of a terminal. The second rubber dome is a dome-shaped portion located between the first rubber dome and the air entrapment chamber. The first ventiduct communicates an inside of the first rubber dome and an inside of the second rubber dome. The second ventiduct communicates the inside of the second rubber dome and an inside of the air entrapment chamber. The first rubber dome and the second rubber dome are constituted to be subjected to a pressing operation with an operation member.

SUMMARY

Both the first rubber dome and the second rubber dome in the related art described in JP 2010-40490 A changes in shapes according to the operation with the operation member. For example, when the second rubber dome is pressed and approaches the fixed contact disposed on the substrate, a size of a flow path between the second rubber dome and the substrate becomes substantially as large as respective flow paths of the first ventiduct and the second ventiduct. Then, there has been a possibility that foreign matter erroneously entering between the rubber contact and the substrate reaches the second ventiduct without flowing into the second rubber dome, or foreign matter entering inward to a space between the second rubber dome and the substrate flows out of the second rubber dome. That is, there has been a technical demand for the related art that it is desired to suppress the possibility that the foreign matter entering between the rubber contact and the substrate reaches a contact.

Thus, an object of the invention is to provide a switch device and a rubber contact capable of suppressing foreign matter from reaching a contact.

[1] In order to achieve the above object, a switch device is provided that includes a substrate having at least one fixed contact, and an inflow/outflow section provided with at least one through-hole penetrating such that fluid passes through, and a rubber contact configured to cover the substrate, in which the rubber contact includes at least one moving section disposed facing the respective at least one fixed contact, the moving section elastically deforming such that moving contacts corresponding to the respective fixed contacts are capable of contacting/separating, an in/out section disposed facing the inflow/outflow section and configured to form a space with the inflow/outflow section, a flow path section constituting a flow path configured to connect the in/out section and the at least one moving section, and at least one chamber section having a space larger than a space occupying along representative length of the flow path section on a portion of the flow path section, and having strength such that a shape of the space is maintained.

[2] The switch device described in [1] described above may be configured such that, the number of the at least one fixed contact is two or more, one of the moving sections is located at a rear end of a flow path in the flow path section, other moving sections among moving sections are located in a middle of a flow path in the flow path section, and the at least one chamber section is provided between the moving sections in the flow path section.

[3] Further, the switch device described in [1] or [2] described above may be configured such that, the chamber section is formed such that height of a space in the chamber section is larger than height of a flow path in the flow path section.

[4] Further, the switch device described in [3] described above may be configured such that, a shape of the space in the chamber section is a cube.

[5] Further, the switch device described in [3] described above may be configured such that, a shape of the space in the chamber section is a truncated cone.

[6] In order to achieve the above object, a rubber contact is provided that is configured to cover a substrate having at least one fixed contact, and an inflow/outflow section provided with at least one through-hole penetrating such that fluid passes through, the rubber contact including at least one moving section disposed facing the respective at least one fixed contact, the moving section elastically deforming such that moving contacts corresponding to the respective fixed contacts are capable of contacting/separating, an in/out section disposed facing the inflow/outflow section and configured to form a space with the inflow/outflow section, a flow path section constituting a flow path configured to connect the in/out section and the at least one moving section, and at least one chamber section having a space larger than a space occupying along representative length of the flow path section on a portion of the flow path section, and having strength such that a shape of the space is maintained.

[7] Further, the rubber contact described in [6] described above may be configured such that, the number of the at least one fixed contact is two or more, one of the moving section is located at a rear end of a flow path in the flow path section, other moving sections among moving sections are located in a middle of a flow path in the flow path section, and the at least one chamber section is provided between the moving sections in the flow path section.

ADVANTAGEOUS EFFECT OF THE INVENTION

According to an aspect of the invention, foreign matter can be suppressed from reaching a contact.

DESCRIPTION OF EMBODIMENTS

Figure 1A:
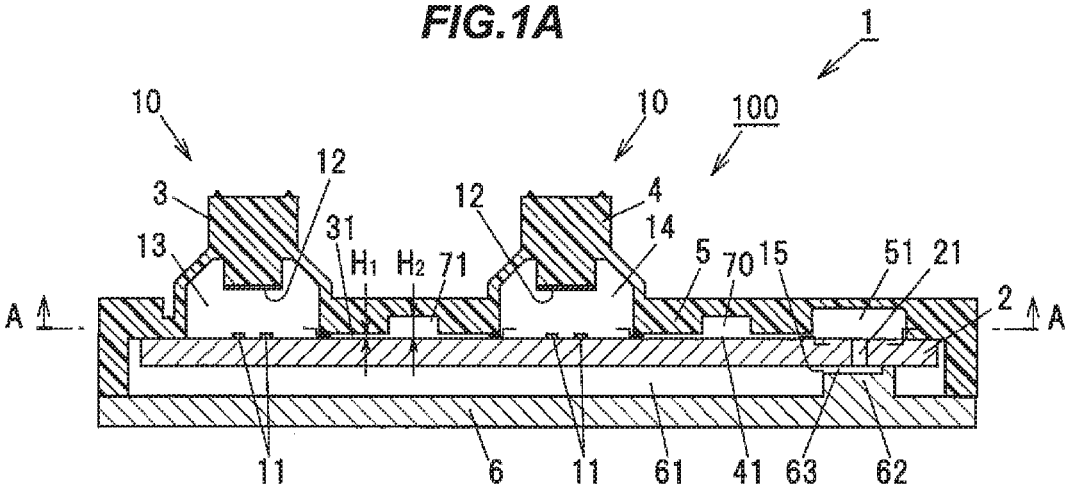
FIG. 1A is a cross-sectional view schematically illustrating an example of a main component of a switch device according to an embodiment of the invention.

Switch Device According to Embodiment of the Invention

A switch device 1 according to an embodiment of the invention includes a substrate 2 having at least one fixed contact 11, and an inflow/outflow section provided with at least one through-hole 21 penetrating such that fluid passes through, and a rubber contact 100 configured to cover the substrate 2, in which the rubber contact 100 is configured to include moving contact sections 3 and 4 being at least one moving section disposed facing the respective at least one fixed contact 11, and elastically deforming such that moving contacts 12 corresponding to the respective fixed contacts 11 are capable of contacting/separating, a vent cavity portion 51 as an in/out section disposed facing the inflow/outflow section and configured to form a space with the inflow/outflow section, an air groove 41 as a flow path section configured to form a flow path configured to connect the vent cavity portion 51 and the at least one moving contact section, and at least one chamber section 70 having a space larger than a space occupying along representative length of the air groove 41 on a portion of the air groove 41, and having strength such that a shape of the space is maintained.

An example of the fluid is air, but the present embodiment can be applied to other gases, liquids or the like. Hereinafter, explanations will be given, provided that the fluid in the present embodiment is air, and the flow path section is the air groove.

Further, an embodiment to be described below can be applied to switch devices of various devices such as vehicle-mounted devices such as air conditioners and door mirrors, remote operation devices such as personal computers and mobile phones, and home electrical devices such as refrigerators and washing machines.

Overall Configuration of a Switch Device

In FIG. 1A, the switch device 1 includes two switch portions, which are a first switch portion 10 and a second switch portion 10, configured to perform a switch operation in response to a pressing operation of an operation member. Each of the switch portions 10 is constituted by, the two fixed contacts 11 and 11 that are electrically connected to wiring of the substrate 2, and the elastically deformable and dome-shaped first moving contact section 3 or second moving contact section 4 including the moving contact 12 capable of contacting to and separating from the fixed contacts 11, and has substantially the same structure.

Figure 1B:
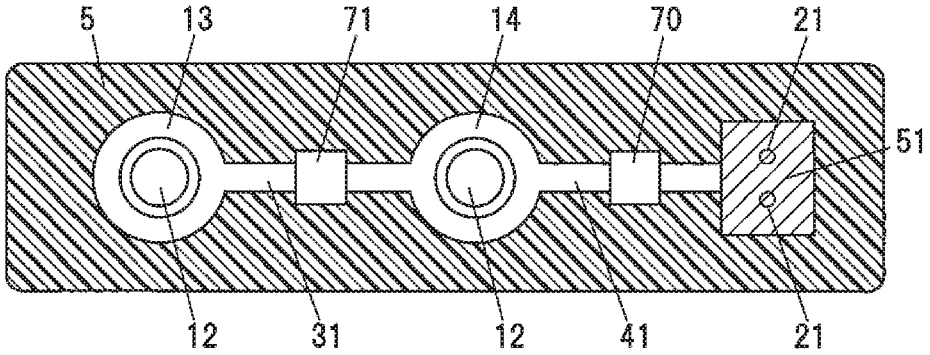
FIG. 1B is an A-A cross-sectional view for explaining an example of an internal structure of the switch device according to the embodiment.

As illustrated in FIG. 1A and FIG. 1B, each of the first moving contact section 3 and the second moving contact section 4 is formed as a dome-shaped cavity section at a portion corresponding to the fixed contacts 11 in one elastic sheet 5 covering the substrate 2. The moving contact 12 is provided on each of an internal bottom face forming a cavity section 13 of the first moving contact section 3 and an internal bottom face forming a cavity section 14 of the second moving contact section 4. A cover member 6 is disposed facing to a back surface of the substrate 2, and the elastic sheet 5 is fixedly supported by the cover member 6.

Figure 1C:
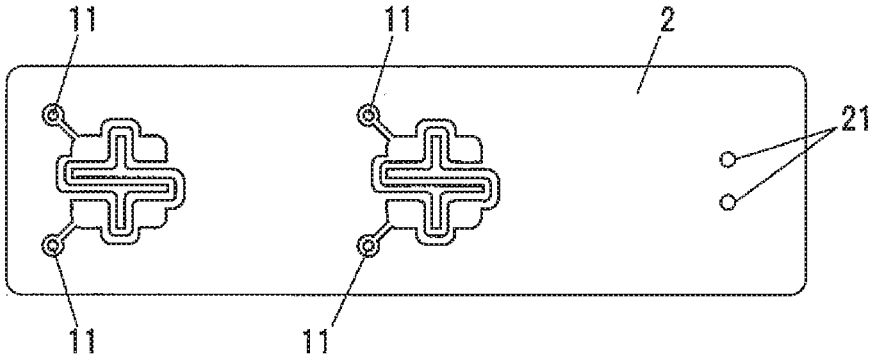
FIG. 1C is a plan view for explaining an example of a substrate used in the switch device according to the embodiment.

As illustrated in FIG. 1C, the fixed contact 11 has a pattern in which a meandering conductor, a bent conductor, and a branched conductor are continuous on the substrate 2, with the two fixed contacts 11 and 11 formed in a comb teeth shape engaged with each other. With such a configuration, even when the moving contact section 12 deviates from the fixed contact 11 during the pressing operation on the moving contact sections 3 and 4, an allowable range of the contact deviation can be expanded, enabling a conduction failure and the like between the fixed contact 11 and the moving contact 12 to be alleviated.

The fixed contact 11 and the moving contact 12 are made of metal materials having conductive properties such as copper or silver. The substrate 2 is made of an insulating rigid plate, and the elastic sheet 5 is made of a member having elasticity such as a rubber material or a soft resin material. In the illustrated example, a part of a rubber contact formed of a silicone rubber is used for the elastic sheet 5 and the two moving contact sections 3 and 4 which are dome-shaped cavity sections.

Rubber Contact

The rubber contact 100 is the elastic sheet 5 covering the substrate 2, and constituted by the elastically deformable and dome-shaped cavity section 14 formed such that the moving contact sections 3 and 4 including the moving contact 12 corresponding to the fixed contact 11 are capable of contacting to and separating from the fixed contact 11, the vent cavity portion 51 provided corresponding to the through-hole 21, and the chamber section 70 formed as a space being a different space from a space of the air groove 41 on a portion of the air groove 41 communicating with the cavity section 14 and the vent cavity portion 51 between the substrate 2 and the elastic sheet 5, and having strength such that a shape of the space is maintained. At least one chamber section 70 has a space larger than a space occupying along representative length of the air groove 41 on a portion of the air groove 41, and is constituted to have strength such that a shape of the space is maintained.

In the present embodiment, the rubber contact 100 has at least two or more cavity sections of the moving contact sections 3 and 4 corresponding to the fixed contacts 11, and the cavity sections 13 and 14 communicate with one another via the air groove 31 as one flow path section.

Further, a chamber section 71 is formed, between the substrate 2 and the elastic sheet 5, as a space being a different space from a space of an air groove on a portion of the air groove 31 communicating with the cavity sections 14, and is constituted to have strength such that a shape of the space is maintained. That is, a configuration is adopted in which when a plurality of moving contact sections is present, the chamber sections 70 and 71 are provided between the respective moving contact sections.

Each of the chamber sections 70 and 71 has a pocket structure for trapping foreign matter moving together with air passing through the respective air groove 31 and 41. Accordingly, as illustrated in FIG. 1A, the chamber sections 70 and 71 are configured such that a value of a space height $H_2$ of the chamber sections 70 and 71 is set larger than a value of a path height $H_1$ of the air groove 31 and 41. Note that, air passage mainly means, air inflow from the through-hole 21, or air outflow to the through-hole 21.

A spatial shape of each of the chamber sections 70 and 71 is a cube. In other words, as illustrated in FIG. 1A and FIG. 1B, the spatial shape of each of the chamber sections 70 and 71 is the cube in which a cross-sectional shape of a cuboid is identical until the space height $H_2$ in a height direction.

Figure 4:
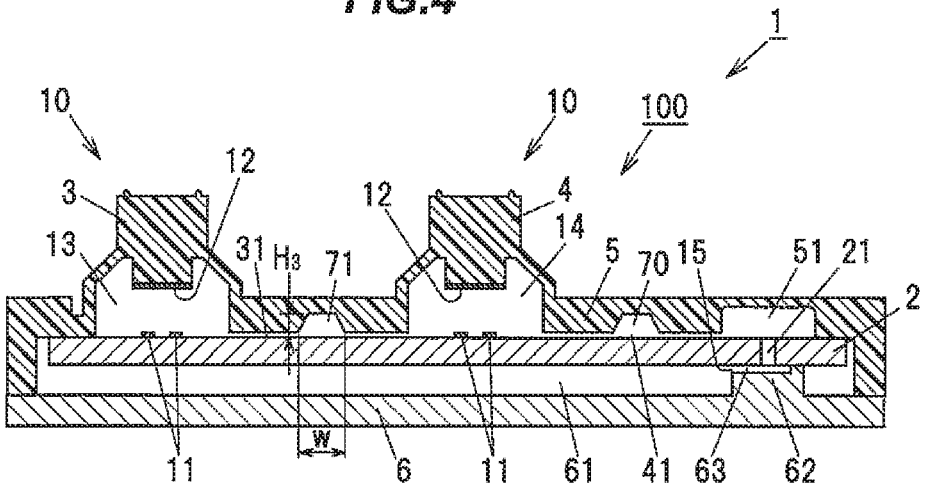
FIG. 4 is a cross-sectional view of a main component corresponding to FIG. 1A when a shape of a space in a chamber section is a truncated cone in the internal structure of the switch device according to the embodiment.

Additionally, as illustrated in FIG. 4, a spatial shape of each of the chamber sections 70 and 71 is a truncated cone. The truncated cone refers to a solid body of a remaining portion obtained by cutting a head of a cone with a plane parallel to a bottom surface, such as a prismoid or a circular truncated cone. In other words, the spatial shape of each of the chamber sections 70 and 71 may be a truncated cone in which a width W of the cross-sectional shape illustrated in FIG. 4 gradually decreases until a space height $H_3$.

A spatial shape of the chamber section may be another spatial shape, as long as the chamber section exerts a function as a pocket structure for trapping foreign matter moving together with air passing through the air groove 31 or 41.

Configuration of Mechanism to Suppress Ingress of Foreign Matter

As illustrated in FIG. 1A and FIG. 1B, between a back surface of the elastic sheet 5 and the substrate 2, the first air groove 31 communicating with the cavity section 13 of the first moving contact section 3 and the cavity section 14 of the second moving contact section 4, and the second air groove 41 communicating with the cavity section 14 of the second moving contact section 4 are formed. The second air groove 41 communicates with the vent cavity portion 51 provided corresponding to the through-hole 21.

The first air groove 31 and the second air groove 41 are formed in a recessed groove shape sunken in the back surface of the elastic sheet 5. The first air groove 31 and the second air groove 41 are connected as one flow path section. As a result, air existing in the cavity sections 13 and 14 of the respective first and second moving contact sections 3 and 4 can enter and exit.

Note that the first air groove 31 and the second air groove 41 having such strength where spatial shapes of the respective air grooves can be maintained to such an extent that air can pass through when the moving contact sections 3 or 4 is pressed.

The above-described chamber sections 70 and 71 are formed on respective portions of the first air groove 31 and the second air groove 41. This chamber section functions as the pocket structure for trapping foreign matter moving together with air passing through the air groove 31 or 41.

As illustrated in FIG. 1A and FIG. 1B, since the chamber sections 71 and 70 are provided on the respective portions of the first air groove 31 and the second air groove 41, foreign matter such as dust or water droplets are trapped in the chamber sections 71 and 70 in a middle of moving, a configuration in which ingress of foreign matter from the vent cavity portion 51 into the cavity sections 13 and 14 of the respective moving contact sections 3 and 4 hardly occurs is obtained.

Two of the through-holes 21 and 21 formed penetrating the substrate 2 communicate with the vent cavity portion 51 that is in communication with the second air groove 41. An internal bottom face of the vent cavity portion 51 is configured larger than an internal bottom face of the second air groove 41. The through-hole 21 communicates with an inner space 61 of the cover member 6 disposed facing the substrate 2.

These through-holes 21 are provided at positions corresponding to the vent cavity portion 51 and communicate with the air groove 41. The through-hole 21 is an independent through-hole not electrically connected to the fixed contact 11 or a circuit of the substrate 2, and not inserted with electrical parts, leads, or the like mounted on the substrate, and serves as an entrance to let air existing in the cavity section 13 of the first moving contact section 3 or the cavity section 14 of the second moving contact section 4 enter and exit when the moving contact sections 3 or 4 is subjected to the pressing operation. By making the through-hole electrically independent of the fixed contact 11 and a circuit of the substrate 2, even when water droplets or the like enter into the through-hole, electric corrosion of a through-hole portion, short-circuit with circuits, and the like, can be suppressed.

Since it is also possible to form a through-hole for connecting a mounted component mounted on the substrate 2 and the fixed contact 11, and the through-hole 21 simultaneously, the mechanism to suppress ingress of foreign matter can be efficiently manufactured.

A gap 15 formed between a surface of the cover member 6 facing the through-hole 21 of the substrate 2 and the back surface of the substrate 2 is set to a value smaller than foreign matter of a prescribed size. This prescribed size is a size of a gap, for example, set to about 0.3 mm or less, capable of preventing intrusion of dust, water droplets, or insects such as ants. This gap 15 is set to a size that suppresses intrusion of not only foreign matter such as dust and water droplets but also insects such as ants.

In the illustrated example, the surface of the cover member 6 facing the through-hole 21 of the substrate 2 is constituted by a top portion of a ridge portion 62 protruding from a bottom surface of the cover member 6. At the top portion of the ridge portion 62 is formed a vent recess 63 to let air in the cavity sections 13 and 14 of the respective two moving contact sections 3 and 4 enter and exit through the through-hole 21 during the pressing operation on the two moving contact sections 3 or 4. The gap 15 formed between an internal bottom face of the vent recess 63 and the back surface of the substrate 2 is set to a value smaller than a prescribed size of foreign matter, for example, about 0.3 mm or less.

The entrance to let the air existing in the cavity sections 13 and 14 of the respective two moving contact sections 3 and 4 enter and exit does not need to be constituted by the two through-holes 21 but may be a single through-hole. By providing two or more through-holes 21, when one through-hole becomes clogged, it is possible to let the air existing in the cavity sections 13 and 14 of the respective moving contact sections 3 and 4 enter and exit to and from a back surface side of the substrate 2 through another through-hole which is not clogged.

Pressing Operation in Switch Device

Figure 2:
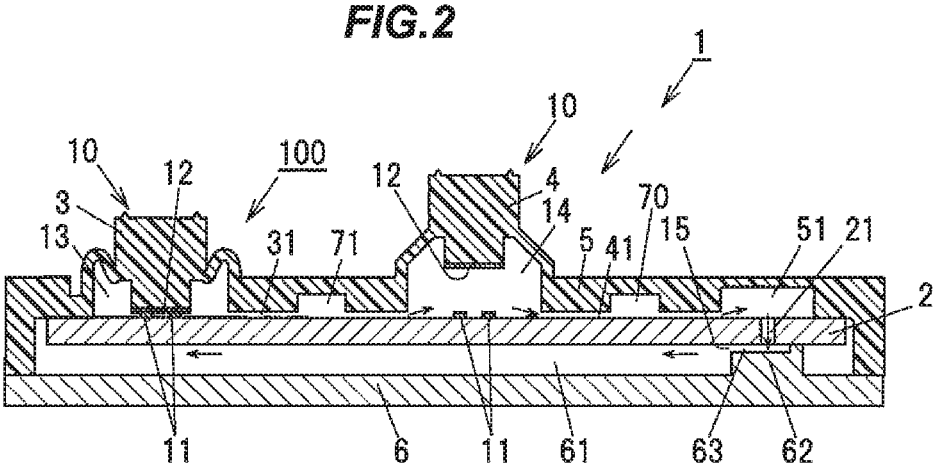
FIG. 2 is a cross-sectional view of a main component corresponding to FIG. 1A for explaining a flow of air inside the switch device according to the embodiment.

As illustrated in FIG. 2, when the first moving contact section 3 is subjected to the pressing operation, compression and deformation occur by inverting operation of the moving contact section 3. A lower surface of the moving contact 12 of the moving contact section 3 comes into contact with the fixed contact 11 of the substrate 2, and the fixed contact 11 and the moving contact 12 are brought into a switched ON-state.

At the time of the inverting operation of the moving contact section 3, the air existing in the cavity sections 13 and 14 of the respective moving contact sections 3 and 4 can be released to the back surface side of the substrate 2 from one flow path section constituted by the first air groove 31 and the second air groove 41, through the vent cavity portion 51 and the through-hole 21.

On the other hand, when pressing force on the first moving contact section 3 is released, the moving contact section 3 automatically returns to the original dome shape due to elastic restoring force. The moving contact 12 of the moving contact section 3 is separated from the fixed contact 11 of the substrate 2, and the fixed contact 11 and the moving contact 12 are brought into a switched OFF-state.

Figure 3:
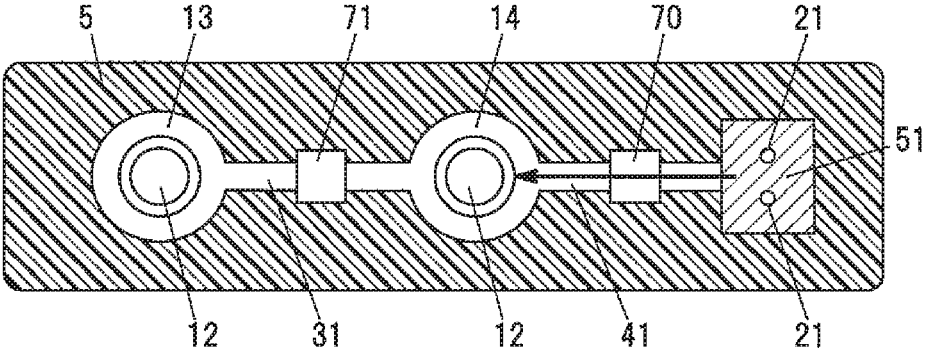
FIG. 3 is a cross-sectional view of a main component corresponding to FIG. 1B for explaining a flow of air inside the switch device according to the embodiment.

The automatic return of the moving contact section 3, as illustrated in FIG. 3, has an action of suctioning air on the back surface side of the substrate 2 through the through-hole 21, the vent cavity portion 51, the second air groove 41, and the first air groove 31, and it is possible to guide air into the cavity sections 13 and 14 of the respective moving contact sections 3 and 4.

Effect of Embodiments

According to an embodiment of the invention, effects such as those described below are achieved. (1) A switch device 1 according to an embodiment of the invention includes a substrate 2 having at least one fixed contact 11, and an inflow/outflow section provided with at least one through-hole 21 penetrating such that fluid passes through, and a rubber contact 100 configured to cover the substrate 2, in which the rubber contact 100 is configured to have moving contact sections 3 and 4 being at least one moving section disposed facing the respective at least one fixed contact 11, and elastically deforming such that moving contacts 12 corresponding to the respective fixed contacts 11 are capable of contacting/separating, a vent cavity portion 51 as an in/out section disposed facing the inflow/outflow section and configured to form a space with the inflow/outflow section, an air groove 41 as a flow path section constituting a flow path configured to connect the vent cavity portion 51 and the at least one moving contact section, and at least one chamber section 70 having a space larger than a space occupying along representative length of the air groove 41 on a portion of the air groove 41, and having strength such that a shape of the space is maintained. In addition, a configuration is adopted in which when a plurality of moving contact sections is present, the chamber sections 71 are also provided between the respective moving contact sections. As described above, since the chamber sections having the pocket structure for trapping foreign matter are included, for example, it is possible to be able to suppress foreign matter intruding from the through-holes 21 from reaching contacts.

(2) Since the first air groove 31 communicating with the cavity section 14 of the moving contact section 3 and the second air groove 41 communicating with the cavity section 14 of the moving contact section 4 are formed as the flow path section including the chamber sections, it enables the possibility that failures such as contact failures due to foreign matter occurring at the first moving contact section 3 and the second moving contact section 4 at the same time to be reduced.

(3) Configuring the gap 15 formed between the surface of the cover member 6 facing the through-hole 21 of the substrate 2 and the back surface of the substrate 2 to about 0.3 mm or less enables ingress of foreign matter such as not only dust and water droplets but also insects such as ants to be reduced.

Note that, in the above embodiment, the switch device 1 is exemplified which is constituted by two sets of the switch portions 10, which are, respectively a set of the fixed contact 11 and the first moving contact section 3, and a set of the fixed contact 11 and the second moving contact section 4. Here, the switch device may be a switch device configured to switch two or more sets of the switch portions 10 simultaneously, or a switch device configured to switch any of two or more sets of the switch portions 10 individually.

In addition, the switch device does not need to be constituted by two or more sets of switch portions 10, and may of course be constituted by a single switch portion 10.

As it is apparent from the above description, the representative embodiments, modifications, and illustrated examples according to the invention have been exemplified, but the above-mentioned embodiments, modifications, and illustrated examples do not limit the scope of the patent claims and can be implemented in various aspects without departing from the gist thereof. As such, it should be understood that all combinations of the features described in the embodiments, modifications, and illustrated examples are not required parts of the means to solve the problems of the invention.

REFERENCE SIGNS LIST

1 Switch device
2 Substrate
3, 4 Moving contact sections
5 Elastic sheet
6 Cover member
10 Switch portion
11 Fixed contact
12 Moving contact
13, 14 Cavity sections
15 Gap
21 Through-hole
31, 41 Air grooves
32, 42 Bent paths
51 Vent cavity portion
61 Inner space
62 Ridge portion
63 Vent recess
70, 71 Chamber sections
100 Rubber contact

The invention claimed is:

1. A switch device, comprising:

a substrate having at least one fixed contact and an inflow/outflow section provided with at least one through-hole penetrating such that fluid passes through; and a rubber contact configured to cover the substrate, wherein the rubber contact comprises:

at least one moving section disposed facing the respective at least one fixed contact, the moving section elastically deforming such that moving contacts corresponding to the respective fixed contacts are capable of contacting/separating;

an in/out section disposed facing the inflow/outflow section and configured to form a space with the inflow/outflow section;

a flow path section configured to form a flow path configured to connect the in/out section and the at least one moving section; and at least one chamber section occupying a portion along a length of the flow path section and having a larger volume along its length than a same length of the flow path section that does not include the chamber section, and having strength such that a shape of a space of the chamber section is maintained, wherein no contact is disposed in the flow path section, the in/out section and the chamber section.

2. The switch device according to claim 1, wherein the number of the at least one fixed contact is two or more, and further comprising a plurality of moving sections, wherein one of the moving sections is located at a rear end of a flow path in the flow path section, and other of the moving sections are located in a middle of a flow path in the flow path section, and wherein the at least one chamber section is provided between the moving sections in the flow path section.

3. The switch device according to claim 1, wherein the chamber section is formed such that height of a space in the chamber section is larger than height of a flow path in the flow path section in a thickness direction of the substrate.

4. The switch device according to claim 3, wherein a shape of the space in the chamber section is a cube.

5. The switch device according to claim 3, wherein a shape of the space in the chamber section is a truncated cone.

6. The switch device according to claim 1, wherein the number of the at least one fixed contact is two or more, and further comprising a plurality of moving sections, wherein one of the moving sections is located at a rear end of a flow path in the flow path section, and other of the moving sections are located in a middle of a flow path in the flow path section, and wherein the at least one chamber section is provided between the moving sections in the flow path section.

7. The switch device according to claim 1, wherein the in/out section has none of the fixed contact and the moving contact.

8. The switch device according to claim 1, wherein the through-hole is electrically independent of a circuit on the substrate.

9. A rubber contact configured to cover a substrate having at least one fixed contact and an inflow/outflow section provided with at least one through-hole penetrating such that fluid passes through, the rubber contact comprising:

at least one moving section disposed facing the respective at least one fixed contact, the moving section elastically deforming such that moving contacts corresponding to the respective fixed contacts are capable of contacting/separating;

an in/out section disposed facing the inflow/outflow section and configured to form a space with the inflow/outflow section;

a flow path section configured to form a flow path configured to connect the in/out section and the at least one moving section; and at least one chamber section occupying a portion along a length of the flow path section and having a larger volume along its length than a same length of the flow path section that does not include the chamber section, and having strength such that a shape of a space of the chamber section is maintained, wherein no contact is disposed in the flow path section, the in/out section and the chamber section.

10. The rubber contact according to claim 9, wherein the in/out section has none of the fixed contact and the moving contact.

11. The rubber contact according to claim 9, wherein the through-hole is electrically independent of a circuit on the substrate.

* * * * *